United States Patent [19]

Olsen

[11] 3,971,322

[45] July 27, 1976

[54] PRESSURE ACTUATED TUBE PRIMER

[76] Inventor: Charles R. Olsen, 307 Conestoga Way, Suite 37, Eagleville, Pa. 19408

[22] Filed: Jan. 23, 1975

[21] Appl. No.: 543,553

[52] U.S. Cl. ..... 102/86.5; 89/1 B; 102/45

[51] Int. Cl.[2] ..... F42C 19/08

[58] Field of Search ..... 102/86.5, DIG. 5, 27 F, 102/45; 89/1 B

[56] References Cited

UNITED STATES PATENTS

| | | | |
|---|---|---|---|
| 2,785,633 | 3/1957 | Ewing et al. | 102/86.5 |
| 3,404,598 | 10/1968 | Angelos | 89/1 B |
| 3,563,178 | 2/1971 | Caples | 102/86.5 |
| 3,620,121 | 11/1971 | Olsen | 89/1 B |
| 3,911,823 | 10/1975 | Murray et al. | 102/86.5 |

*Primary Examiner*—David H. Brown

*Attorney, Agent, or Firm*—McCormick, Paulding & Huber

[57] ABSTRACT

A percussion-ignitable pressure actuated tube primer has a closed end, thin walled, metal tube which is indented over a portion of its length and is telescoped within a second metal tube. The indentation of the first metal tube defines a space between the first tube and the second metal tubular case. A percussively-ignitable primer mixture is contained in that space and ignites and deflagrates when the indented portion of the first tube is expanded and inverted by internal fluid pressure or a mechanical firing pin entering the first tube, and crushing the primer mixture between the expanding first tube and the bore of the second tubular case. The primer is made by coating the indented portion of the first tube with primer mixture in paste form and subsequently drying the primer mixture.

6 Claims, 8 Drawing Figures

PRESSURE ACTUATED TUBE PRIMER

BACKGROUND OF THE INVENTION

This invention relates to fluid pressure and mechanically actuated percussion-ignitable primers.

Fluid pressure actuated primers have been used to provide sequential actuation of aircraft personnel escape systems. In these sequential actuation devices, fluid pressure ducted from the first actuation enters a chamber and pressurizes a shear pin supported piston breaking the shear pin driving a firing pin on the piston into a conventional primer, initiating the second sequence or pyrotechnic action. These units require O-ring seals around the piston and are limited in shelf life by the aging characteristics of the O-ring material.

Base fuzes for projectiles have long used fluid pressure of the propellant gas ducted through a port in the projectile base to initiate a primer or initiate a pyromechanical action. In these applications sealing is of the utmost importance to prevent hot propellant gas from entering the fuze explosive train and causing premature functioning in the gun or launcher.

Many aircraft and aerospace ordnance components are initiated by electric primers. While the use of electric initiation has generally proven satisfactory, difficulties have been encountered with premature ignition by stray electrical energy. As a result of these problems alternate forms of initiation such as LASER, fluidic and MDF (Mild Detonating Fuse) are sometimes specified. Automotive air bag crash safety systems using an electric primer initiated by an electric signal from a bumper mounted impact sensor present installation and servicing hazards due to the electrical test instrumentation and electric fields found in the automobile. Fluid pressure initiated air bags have been tested but limitations in available fluid pressure sensitive primers have restricted widespread application.

SUMMARY OF THE INVENTION

In accordance with the device of the present invention, the above described and other disadvantages of the prior art are overcome by providing a fluid pressure actuated primer which is immune to electromagnetic radiation and which maintains an integral separator between the fluid pressure and the combustion products of the primer without resorting to O-rings or sliding seals.

A primer of the invention has a thin wall, closed end, metallic tube with an indented tube wall defining a cavity along the exterior of the tube. A percussion-ignitable primer mixture is contained in the space formed by the indented portion on the exterior of the tube and is adapted to be ignited by striking the interior wall of a case which is telescoped over the tube, when the indent in the tube is inverted by pressure applied to the interior of the tube by pneumatic, hydraulic or mechanical means.

Moreover it has been found that by controlling the geometry of the arch formed by the indent in the tube that a snap action is obtained when the fluid pressure within the tube exceeds the critical pressure which causes the arch to collapse. This snap action at the critical pressure threshold gives both safety and reliability since the primer will not deform and function below this critical pressure while function is fast above this pressure, since the arch continues to invert crushing the primer mixture to give reliable ignition. The actuated primer maintains a separator between the actuating fluid pressure and the pyrotechnic output of the primer since the indented tube is supported by the case and will withstand pressures many times the critical pressure without rupturing. This primer operates equally well upon stored gas, hot propellant gas, hydraulic fluid pressure, or the shock wave from an explosive such as mild detonating fuse.

The primer has only three components, a ductile, closed end, thin walled tube having a longitudinal indent near the closed end, an outer case and the primer mixture.

When fluid pressure, a mechanical firing pin or a shock wave is introduced into the inlet port of the tube the indent is inverted causing the primer mixture to be crushed between the inverting tube and the case wall, firing the primer.

The primer can be used to provide instantaneous or delay operation of a wide variety of pyromechanical devices and explosive outputs such as a gas generator, ignitor, primer, detonator or gasless heat generator. The primer thus can be substituted for electroexplosive initiators in many aerospace explosive system applications.

Operating pressures can be controlled by selection of the tube material, tube diameter and wall thickness. Operating pressures of as low as 100 pounds to as high as 60,000 pounds per square inch can be accommodated by selection of proper tube and supporting case design.

The primer requires no exit port for flow through of gas as is required in fluidic resonance initiators.

The small diameter tubular construction of the primer makes it particularly adaptable for use with the small diameter metal sheathed pyrotechnic cords such as Mild Detonating Fuse, Low Energy Deflagrating Fuse and Small Column Insulated Delay Cord. These materials can be sealed and crimped directly into the primer and use the primer as a transfer means and barrier for transfering from one type to another such as actuation by Mild Detonating Fuse inserted into the inlet port with the primer transfering the energy to light a length of Small Column Insulated Delay without leakage between the two pyrotechnics.

The primer may also be used as an explosive diode in this system since the explosive action will proceed in one direction only through the primer. In the event that the Small Column Insulated Delay or the primer mixture were inadvertantly ignited the Mild Detonating Fuse would not be detonated and cause premature ignition of other ordnance upstream of the primer.

The primer of the present invention is well suited to use with a binary primer mixture in which two nonexplosive primer ingredients are brought together to form an explosive composition only at the instant of functioning since the primer mixture is transferred from one location to another when fired. In a binary primer embodiment of the present invention ingredient A may be coated in the indented portion of the tube while ingredient B may be coated upon the case wall so that they are separately stored and yet brought together under pressure at activation.

Accordingly it is a primary object of the invention to provide a fluid pressure sensitive primer in which the primer mixture is carried in an indentation in the wall of the pressure responsive tube.

Another object is to provide a primer which is insensitive to electromagnetic radiation, static electricity, lightning or nuclear radiation.

Yet another object is to provide a primer which consists essentially of an indented tube containing a percussion-ignitable mixture in the indent of the indented tube which is telescoped within the bore of the case.

A still further object of the invention is to provide a primer which can be manufactured at minimal cost.

A still further object of the invention is to provide a fluid pressure actuated primer having no elastomeric seals subject to age deterioration.

A still further object of the invention is to provide a percussion sensitive primer of small diameter.

These and other objects and advantages of the invention will become more readily apparent from the following detailed description, taken in conjunction with the accompanying drawings.

DESCRIPTION OF PREFERRED EMBODIMENTS

Figure 1:
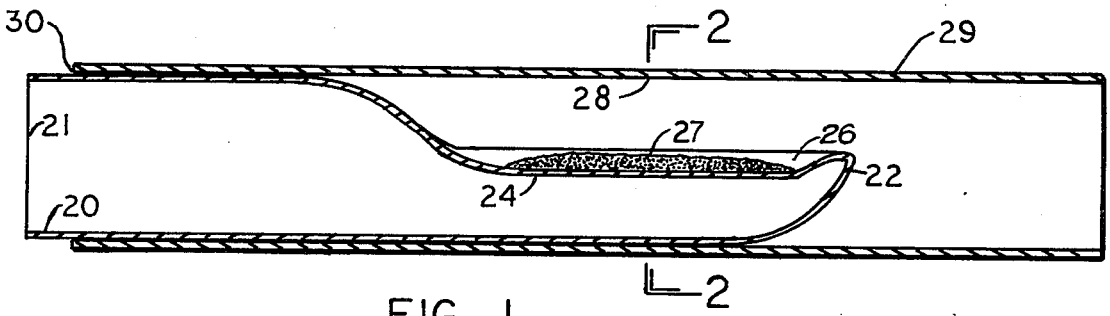
FIG. 1 is a longitudinal sectional view of a first embodiment of the fluid pressure actuated primer according to the invention.

Referring to Figures one and two, a primer according to the invention comprises a thin walled tube 20 which is made of a ductile, deformable metal such as stainless steel or copper. The wall of the tube, for example, my be of a thickness of the order of 0.003 inches. The left end of the tube 20 is open to thereby define a port 21 for the entry of a fluid pressure actuating media. The right end of the tube 20 is closed at 22 and the right hand portion of the tube 20 is indented in such a manner as to form a longitudinally extending interior flute 24 which defines a longitudinally extending concave cavity 26 along the exterior of the tube which is generally coextensive with the longitudinal flute 24. The tube 20 is thus constituted by a closed end, fluted section and an open end cylindrical section. The exterior concavity 26 of the fluted section contains a quantity of percussion-ignitable primer mixture 27 adapted to ignite and deflagrate when the indented portion 24 yields under internal fluid pressure driving the primer mixture 27 against the inner wall 28 of the case 29 which is telescoped over the tube 20. As seen in FIG. 1 the case 29 may be sealingly affixed to the tube 20 at 30 by soldering, welding, adhesive bonding or other means.

Figure 2:
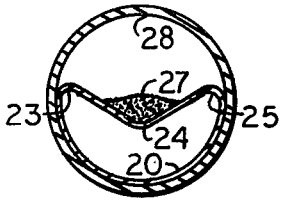
FIG. 2 is a transverse sectional view of the indented portion of the primer of FIG. 1 taken on the line 2—2 of FIG. 1.
Figure 3:
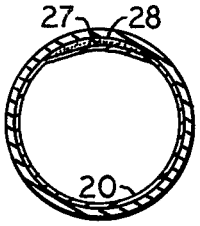
FIG. 3 is a transverse sectional view similar to FIG. 2 showing that embodiment in the fired condition.

Referring now to Figures two and three it can be seen that when the pressurizing fluid is introduced into the interior of the tube 20 the arch represented by the points 23, 24 and 25 of FIG. 2 resists deformation until a critical pressure is reached at which time the arch collapses driving the primer mixture 27 against the case wall 28 as seen in FIG. 3 percussively igniting the primer mixture 27.

Figure 4:
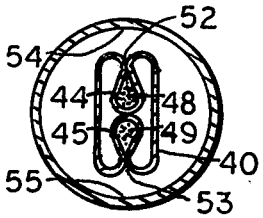
FIG. 4 is a transverse sectional view similar to FIG. 2 of another embodiment of the invention.

The embodiment shown in FIG. 4 differs from the previous embodiment only in the form and number of indents in the tube. The tube 40 is indented in two places 44 and 45 and the indents filled with primer mixtures 48 and 49 with the tube swaged closed around the primer mixtures as seen at 52 and 53. This embodiment operates in the same manner as the embodiment shown in Figures one, two and three by internal pressure in the tube 40 overcoming the yield strength of the tube material and expanding the fluted portions 44 and 45 until the flutes are inverted crushing the primer mixtures 48 and 49 against the case wall at 54 and 55.

Figure 5:
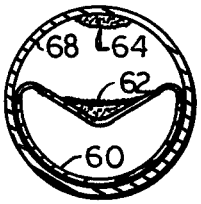
FIG. 5 is a transverse sectional view similar to FIG. 2 of yet another embodiment of the invention.

The different embodiment shown in FIG. 5 has a primer mixture in binary form. In this embodiment the primer mixture is divided into two components 62 and 64 which may be nonexplosive or of low sensitivity individually but which react in an explosive manner when the two components are brought together under pressure. The first component of the primer mixture 62 is applied to the indented portion of the tube 60 in a manner similar to the embodiment shown in FIG. 2 while the second component 64 of the primer mixture is applied to the case wall 68 at a point opposing the first component of the primer mixture 62 in the indented tube. Function is similar to the function of FIG. 3 except that in this embodiment the primer mixture is finally mixed only when the two components 62 and 64 are crushed together between the expanding tube 60 and the case wall 68. Many primer materials can be used in this binary primer embodiment, for example one component may contain primarily a fuel such as red phosphorus while the other component may contain an oxidizer such as barium nitrate. Neither primer component 62 or 64 being explosive as stored, the binary primer offers improved safety in manufacturing and use.

Figure 6:
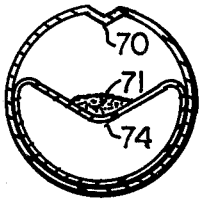
FIG. 6 is a transverse sectional view similar to FIG. 2 of still another embodiment of the invention.

Referring now to FIG. 6, an embodiment is shown having a protrusion 70 formed in the case wall to act as an anvil, increasing the unit pressure and thus the sensitivity by decreasing the area of contact with the primer mixture 71 when the tube indent 74 is inverted crushing the primer mixture 71 against the protrusion 70. The protrusion 70 may be in the form of a single or series of ridges, either longitudinal or transverse, a single or series of points, or an additional component such as a wire or screen, positioned between the primer mixture 71 and the case wall.

Figure 7:
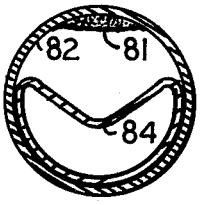
FIG. 7 is a transverse sectional view similar to FIG. 2 of still another embodiment of the invention.

Referring now to FIG. 7, this embodiment has the primer mixture 81 positioned on the case wall 82 at a point opposite the tube indent 84 so that the primer mixture 81 is crushed by the inverting tube indent 84 when the tube is internally pressurized, actuating the primer.

Figure 8:
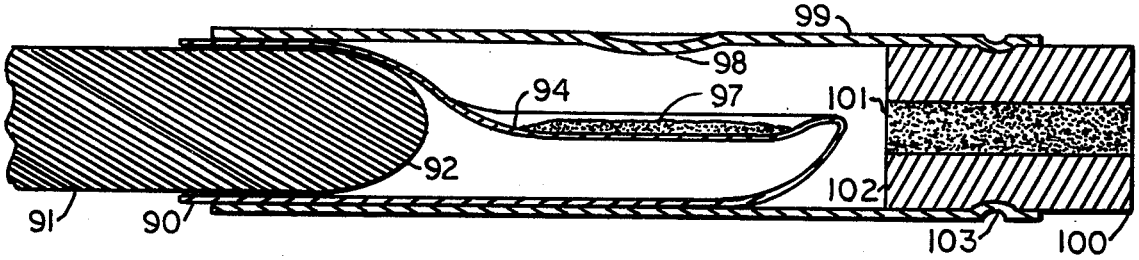
FIG. 8 is a longitudinal view in section of still another embodiment of the invention.

A method of mechanical actuation of the primers of the present invention is shown in FIG. 8. In this embodiment a firing pin 91, having a smooth pointed tip 92 is shown positioned in the bore of the tube 90. This embodiment is actuated by a mechanical force applied axially to the firing pin 91, forcing the pin into the tube 90 and inverting the indent 94 thus crushing the primer mixture 97 against the protruding anvil 98 on the bore of the case 99. A typical application of this embodiment is illustrated at the right end of FIG. 8 where a length of small column insulated delay fuse 100 having a pyrotechnic core 101 contained in a metal sheath 102 is shown crimped into the case 99 by an indent 103. This combination of firing pin, primer and delay column has particular use in grenade fuzing where it can provide a small diameter, low cost delay fuze.

An example of a preferred primer mixture which exhibits the desired safety and sensitivity characteristics is that composition known in the art as "Armstrongs Mixture" as modified by the addition of a gritty substance, such as boron carbide. More specifically, a preferred primer mixture may be constituted by the following composition in percentages by weight of: 70 percent potassium chlorate, 19 percent red phosphorus, 3 percent sulphur, 3 percent precipitated chalk and 5 percent boron carbide. However it will be appreciated that numerous other compositions could be employed to carry out the invention. An adhesive binder may be added to the composition and a foil or tissue may be bonded to the composition to prevent dusting of the composition.

While only a few embodiments of the invention have been set forth hereinabove, it will be understood that changes and modifications may be made thereto without departing from the spirit and scope of the invention as defined in the subjoined claims.

What is claimed is:

1. A tubular primer comprising:

a deformable metal tube having at least one indented portion defining a longitudinally extending, concavely-shaped cavity on the exterior thereof;

a case having a bore into which the tube is telescoped and defining a space within the bore between the indented portion of the tube and the case; and a percussion-ignitable primer mixture situated within said space between the indented portion and the case whereby the indented portion may be deformed by internal force within the tube, crushing the primer mixture against the case wall thereby igniting and deflagrating the primer mixture.

2. A tubular primer as defined in claim 1, having at least one protrusion extending inwardly on the case wall defining an anvil thereupon.

3. A tubular primer as defined in claim 1, having the percussion-ignitable primer mixture affixed to the case wall at a point opposite the indented portion of the tube.

4. A tubular primer as defined in claim 1, wherein the percussion-ignitable primer mixture is separated into two components, with a first component contained in the indented portion of the tube and the second component affixed to the case wall at a point opposite the indented portion in such a manner that when the indented portion is inverted by an internal force within the tube, the two components are crushed together between the case wall and the inverted indented portion, thereby mixing, igniting and deflagrating the primer mixture.

5. A tubular primer as defined in claim 1, wherein the indented portion of the tube is folded closed over the primer mixture.

6. A tubular primer as defined in claim 1, having a firing pin member positioned within the indented tube such that a force applied to the firing pin may expand the indented portion of the tube, crushing and thereby igniting and deflagrating the primer mixture.

* * * * *